US009745664B2

(12) United States Patent
Takeda

(10) Patent No.: US 9,745,664 B2
(45) Date of Patent: Aug. 29, 2017

(54) METHOD FOR PRODUCING A FIXATION BELT

(71) Applicant: SYNZTEC CO., LTD., Tokyo (JP)

(72) Inventor: Minoru Takeda, Tokyo (JP)

(73) Assignee: SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 14/858,182

(22) Filed: Sep. 18, 2015

(65) Prior Publication Data

US 2016/0010234 A1 Jan. 14, 2016

Related U.S. Application Data

(63) Continuation of application No. 13/377,302, filed as application No. PCT/JP2010/062950 on Jul. 30, 2010, now abandoned.

(30) Foreign Application Priority Data

Jul. 31, 2009 (JP) ..... 2009-180142

(51) Int. Cl.

| | |
|---|---|
| ***H05B 6/00*** | (2006.01) |
| ***H05B 6/10*** | (2006.01) |
| ***C25D 1/04*** | (2006.01) |
| ***G03G 15/20*** | (2006.01) |
| ***H05B 6/14*** | (2006.01) |

(52) U.S. Cl.

CPC ..... *C25D 1/04* (2013.01); *G03G 15/20* (2013.01); *G03G 15/2053* (2013.01); *H05B 6/145* (2013.01)

(58) Field of Classification Search

CPC ..... G03G 13/00; G03G 15/00; H05B 6/00; H05B 6/10

USPC ..... 219/216, 609, 618, 619, 635; 399/328, 399/329, 330, 331, 333

See application file for complete search history.

(56) References Cited

U.S. PATENT DOCUMENTS

| | | | | |
|---|---|---|---|---|
| 7,796,933 | B2 | 9/2010 | Ueno et al. | |
| 2004/0105708 | A1 | 6/2004 | Imai et al. | |
| 2005/0084303 | A1* | 4/2005 | Takagi | G03G 15/2057 399/333 |
| 2007/0223979 | A1* | 9/2007 | Jinzai | G03G 15/2057 399/333 |

(Continued)

FOREIGN PATENT DOCUMENTS

| | | |
|---|---|---|
| CN | 101271311 | 9/2008 |
| JP | 09-044015 | 2/1997 |
| JP | 2001-230064 | 8/2001 |

(Continued)

OTHER PUBLICATIONS

English translation of JP 2007-140086 to Ito Akiko, published Jul. 6, 2007.*

(Continued)

*Primary Examiner* — Michael LaFlame, Jr.
(74) *Attorney, Agent, or Firm* — Young & Thompson

(57) ABSTRACT

An electromagnetic induction heating element includes a first heating layer 11 formed of electrocast nickel and having an endless-belt-like form; a second heating layer 12 formed of a non-magnetic material; and a coating layer 13 having a thickness of 3 μm or less, wherein the first heating layer 11, the second heating layer 12, and the coating layer 13 are sequentially stacked.

10 Claims, 2 Drawing Sheets

(56) References Cited

U.S. PATENT DOCUMENTS

| | | | |
|---|---|---|---|
| 2008/0232873 | A1 | 9/2008 | Ueno et al. |
| 2009/0232565 | A1 | 9/2009 | Yasuda et al. |

FOREIGN PATENT DOCUMENTS

| | | |
|---|---|---|
| JP | 2003-007438 | 1/2003 |
| JP | 2004-070155 | 3/2004 |
| JP | 2005-121825 | 5/2005 |
| JP | 2007-140086 | 6/2007 |
| WO | WO 03/043379 | 5/2003 |

OTHER PUBLICATIONS

International Search Report, PCT/JP2010/062950, dated Nov. 16, 2010.
CN Office Action dated Mar. 11, 2013.

* cited by examiner

METHOD FOR PRODUCING A FIXATION BELT

TECHNICAL FIELD

The present invention relates to an electromagnetic induction heating element having an endless belt formed of electrocast nickel, and to a fixing belt employing the heating element. The electromagnetic induction heating element of the invention is suited for serving as a fixing belt of a fixation member employed particularly in an image-forming apparatus such as a copying machine, a facsimile machine, or a laser printer.

BACKGROUND ART

Recently, image-forming apparatuses have employed a belt-fixation format in order to meet demands such as downsizing, energy-saving, and high printing and copying speed. Thus, a fixation roller employed in an image-forming apparatus has been replaced by a fixing belt having no end (i.e., an endless belt or endless film).

For shortening the rise time and saving energy, there has been proposed an induction-heating-type belt-fixation format in which a magnetic field is applied to a fixing belt formed of a magnetic metal (e.g., nickel) substrate, to thereby generate eddy current for heating the magnetic metal.

In recent years, there is further demand for a fixing belt of high heat generation efficiency, which belt can be heated to a predetermined temperature over a shorter period of time in a more energy-saving manner. In order to meet the demand, there has been proposed a fixing belt for effectively generating heat via electromagnetic induction and ensuring more flexible choice of layer configuration and layer thickness, which belt has a base layer formed of magnetic metal and having high resistivity and relative permeability; a heating layer formed of a non-magnetic conductive metal and having a resistivity and a relative permeability which are sufficiently lower than those of the base layer; and a surface release layer (see Patent Document 1).

However, the above-proposed fixing belt has a problem in that interlayer delamination between the heating layer and the surface release layer occurs. As a result, heating of the metal layer through electromagnetic induction fails to be attained in some cases, which is problematic. In order to solve the problem, there has been proposed a method for producing an endless belt including heating a surface release layer in a non-oxidizing gas atmosphere (see Patent Document 2). In this production method, undesired oxidation of the heating layer is prevented, whereby adhesion between the heating layer and a layer disposed on the peripheral surface of the heating layer can be enhanced, and the thus-produced endless belt can be heated to a temperature allowing image fixation.

PRIOR ART DOCUMENTS

Patent Documents

Patent Document 1: Japanese Patent Application Laid-Open (kokai) No. 2003-7438

Patent Document 2: Japanese Patent Application Laid-Open (kokai) No. 2004-70155

SUMMARY OF THE INVENTION

Problems to be Solved by the Invention

However, when the method for producing an endless belt disclosed in Patent Document 2 is employed, a large-scale heating apparatus must be employed, raising production facility cost. The method also involves time-consuming steps of preparing non-oxidizing gas, changing atmosphere, etc., which unavoidably increase fixing belt production cost. Thus, low-cost production has not been realized.

In addition, since the non-oxidizing gas concentration of the atmosphere is not easily controllable, difficulty is encountered in protection of the surface of the heating layer from oxidation, which is problematic.

In view of the foregoing, an object of the present invention is to provide an electromagnetic induction heating element which is produced at low cost and which attains both high heat generation efficiency and high durability. Another object of the invention is to provide a fixing belt employing the heating element.

Means for Solving the Problems

Accordingly, in a first mode of the present invention, there is provided an electromagnetic induction heating element characterized by comprising:

a first heating layer formed of electrocast nickel and having an endless-belt-like form;

a second heating layer formed of a non-magnetic material; and a coating layer having a thickness of 3 μm or less, wherein the first heating layer, the second heating layer, and the coating layer are sequentially stacked.

A second mode of the present invention is directed to a specific embodiment of the electromagnetic induction heating element of the first mode, wherein the coating layer is formed of a metallic material which has corrosion resistance higher than that of the material forming the second heating layer.

A third mode of the present invention is directed to a specific embodiment of the electromagnetic induction heating element of the first or second mode, wherein the coating layer is formed of nickel or a nickel alloy.

A fourth mode of the present invention is directed to a specific embodiment of the electromagnetic induction heating element of any one of the first to third modes, wherein the second heating layer has been formed through plating.

A fifth mode of the present invention is directed to a specific embodiment of the electromagnetic induction heating element of any one of the first to fourth modes, wherein the coating layer has been produced through plating.

A sixth mode of the present invention is directed to a specific embodiment of the electromagnetic induction heating element of any one of the first to fifth modes, wherein the first heating layer has a phosphorus content of 0.05 mass % to 1 mass %.

A seventh mode of the present invention is directed to a specific embodiment of the electromagnetic induction heating element of any one of the first to sixth modes, wherein the second heating layer is formed of a material having a resistivity lower than that of nickel.

An eighth mode of the present invention is directed to a specific embodiment of the electromagnetic induction heating element of any one of the first to seventh modes, wherein the second heating layer is formed of a material having a resistivity of $2.8\times10^{-8}$ Ω·m or lower and a relative permeability of 2 or lower.

A ninth mode of the present invention is directed to a specific embodiment of the electromagnetic induction heating element of any one of the first to eighth modes, wherein the second heating layer is formed of gold, copper, silver, or aluminum.

A tenth mode of the present invention is directed to a specific embodiment of the electromagnetic induction heating element of any one of the first to ninth modes, wherein the second heating layer has a thickness which is equal to or less than the skin depth of the material of the second heating layer.

In an eleventh mode of the present invention, there is provided a fixing belt characterized by comprising an electromagnetic induction heating element as recited in any one of the first to tenth modes, and a release layer (i.e., a layer for releasing deposition matter) serving as an outermost layer.

A twelfth mode of the present invention is directed to a specific embodiment of the fixation belt of the eleventh mode, wherein the release layer is provided by the mediation of an elastic layer.

Effects of the Invention

The electromagnetic induction heating element of the present invention has a first heating layer formed of electrocast nickel and having an endless-belt-like form; a second heating layer formed of a non-magnetic material; and a coating layer having a thickness of 3 μm or less. Thus, the present invention enables provision, at low cost, of an induction heating element which attains both high heat generation efficiency and high durability, and a fixing belt employing the heating element.

MODES FOR CARRYING OUT THE INVENTION

The electromagnetic induction heating element of the present invention includes a first heating layer formed of electrocast nickel and having an endless-belt-like form; a second heating layer formed of a non-magnetic material; and a coating layer having a thickness of 3 μm or less, wherein the first heating layer, the second heating layer, and the coating layer are sequentially stacked. Since the heating layer of the electromagnetic induction heating element of the present invention has a bi-layer structure of the first heating layer formed of electrocast nickel and the second heating layer formed of a non-magnetic material, heat generation increases, heating efficiency is enhanced, and warming-up time is shortened, as compared with a conventional single-layer-type heating layer. In addition, through provision of a coating layer having a thickness of 3 μm or less on the outer surface of the second heating layer, oxidation of the second heating layer can be prevented, whereby the electromagnetic induction heating element has high durability. Since the coating layer has a thickness as thin as 3 μm or less, lowering in heating efficiency of the electromagnetic induction heating element can virtually be prevented, and serves as a third heating layer, although its heating efficiency is lower than that of the first heating layer or the second heating layer. Thus, the electromagnetic induction heating element can maintain excellent heating efficiency.

Figure 1:
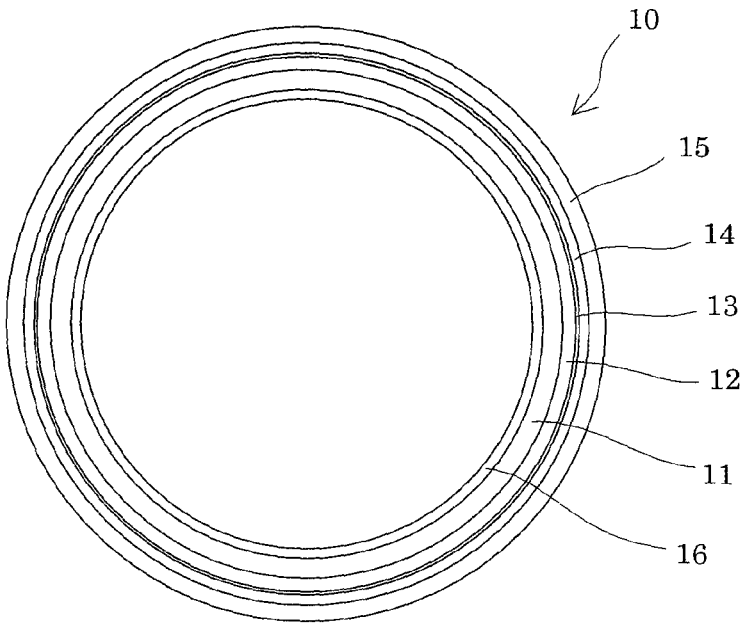
FIG. 1 A sketch of a fixing belt according to one embodiment of the present invention.

Hereinafter, embodiments of the present invention will be described in detail. FIG. 1 is a sketch of an embodiment of the fixing belt of the present invention, having the electromagnetic induction heating element of the present invention.

A fixing belt 10 has a first heating layer 11 formed of electrocast nickel and having an endless-belt-like form; a second heating layer 12 formed of a non-magnetic material; and a coating layer 13 having a thickness of 3 μm or less. In the fixing belt 10 of this embodiment, a release layer 15 is formed on the outer peripheral surface of the coating layer 13 by the mediation of an elastic layer 14. Furthermore, a sliding layer 16 is formed on the inner peripheral surface of the first heating layer 11. The fixing belt 10 of the embodiment is employed in the case where an exciting coil is placed outside the fixing belt 10.

The coating layer 13 has a thickness of 3 μm or less. Through provision of such a very thin coating layer 13 on the outer peripheral surface of the heating layer, the heating layer can be protected virtually without lowering the heating efficiency of the fixing belt 10. Thus, a heating layer having excellent durability can be realized.

The coating layer 13 is preferably formed from a metallic material which has corrosion resistance higher than that of the material of the second heating layer 12. Examples of such a corrosion-resistant metallic material include those having oxidation resistance. The reasons for choice of such metallic material are as follows. After formation of the first heating layer 11 and the second heating layer 12, the fixing belt 10 undergoes heating processes at various temperatures for forming the elastic layer 14, the release layer 15, and the sliding layer 16. During heating processes, the coating layer 13 can prevent oxidation of the second heating layer 12. Also, oxidation of the second heating layer 12, which would otherwise be caused by water contained in the elastic layer 14, can be prevented. Through employment of the structural feature, interlayer delamination between the heating layer (the first heating layer 11 and the second heating layer 12) and the elastic layer 14 or the release layer 15 can be avoided. In addition, failure to flow of current in the heating layer (the first heating layer 11 and the second heating layer 12), which would otherwise be caused by oxidation of the second heating layer 12, can be prevented. Meanwhile, the coating layer 13 preferably exhibits strong adhesion to the second heating layer 12 and to the elastic layer 14 or the release layer 15. Examples of the material of the coating layer 13 include gold, silver, nickel, and nickel alloy. Among them, nickel and nickel alloy are preferred. Examples of the nickel alloy include Ni—P alloy, Ni—Fe alloy, Ni—Co alloy, Ni—Mn alloy, and Ni—Ti alloy. Nickel and Ni-alloys exhibit excellent adhesion to the elastic layer 14 or the release layer 15, whereby oxidation of the second heating layer 12 can be suitably prevented.

The coating layer 13 is preferably formed before oxidation of the second heating layer 12 occurs by contact with air. More preferably, the coating layer 13 is formed under air-tight conditions. Through formation of the coating layer 13 before oxidation of the second heating layer 12 by contact with air, corrosion of the second heating layer 12 can be effectively prevented. The reason for the choice of the time of formation is that oxidation of the second heating layer 12, which would otherwise be caused by contact with air before formation of the elastic layer 14 on the outer peripheral surface of the second heating layer 12 or by water contained in the elastic layer 14, can be effectively prevented.

The coating layer 13 is preferably formed through electroplating. In one exemplified mode, a plating film is formed on the surface of the second heating layer 12 by use of a plating bath, and the formed film is employed as the coating layer 13. In this case, contact of air with the surface of the second heating layer 12 is preferably prevented to a maximum possible degree, whereby corrosion of the second heating layer can be effectively prevented. Through formation of the coating layer 13 through electroplating, adhesion between the coating layer 13 and the second heating layer 12 is enhanced, and the thickness of the coating layer 13 (i.e., 3 μm or less) can be controlled with a high degree of precision. Notably, in the case where nickel is selected as the material, the coating layer 13 may be produced through the same method as employed in formation of the first heating layer 11 described hereinbelow. When a nickel alloy such as Ni—P alloy, Ni—Fe alloy, Ni—Co alloy, Ni—Mn alloy, or Ni—Ti alloy is selected as the material, the coating layer 13 may be formed through the same method as employed in the formation of first heating layer 11 as described hereinbelow, with an appropriate modification of electrode or other conditions. Needless to say, the coating layer 13 may be formed through electroless plating, physical vapor deposition, chemical vapor deposition, or a similar process.

The coating layer 13 has a thickness of 3 μm or less, preferably 0.5 μm to 2 μm. When the thickness is in excess of 3 μm, the heating efficiency of the electromagnetic induction heating element is lowered, whereas when the thickness is less than 0.5 μm, the effect of preventing oxidation of the second heating layer may fail to be fully attained.

The first heating layer 11 is formed of electrocast nickel and has an endless-belt-like shape. In the case where the fixing belt is heated through electromagnetic induction heating, the first heating layer 11 preferably has a thickness of 1 μm to 100 μm. The thickness is generally about 10 to about 100 μm, preferably about 15 to about 80 μm, more preferably about 20 to about 60 μm. When the first heating layer 11 has a thickness less than 1 μm, the first heating layer cannot fully absorb electromagnetic energy, and the heating efficiency tends to decrease, whereas when the thickness of the first heating layer 11 is in excess of 100 μm, rigidity increases, and softness decreases. In this case, the flexibility of the heating layer decreases, and a fixing belt employing the heating layer is not easily employable. From the viewpoint of balanced satisfaction of heat capacity, thermal conductivity, mechanical strength, flexibility, etc., the thickness is most preferably about 30 to about 50 μm. When the heating layer is employed as in a fixing belt of an electrophotographic copier, the width of the heating layer may be appropriately adjusted in accordance with the image-transfer substrate (e.g., paper sheet).

As described above, the first heating layer 11 is formed of electrocast nickel. As used herein, the term "electrocast nickel" refers not only to elemental electrocast nickel but also to electrocast nickel alloys such as Ni—P alloy, Ni—Fe alloy, Ni—Co alloy, Ni—Mn alloy, and Ni—Ti alloy. The electrocast nickel forming the first heating layer 11 is preferably an electrocast Ni—P alloy, more preferably an electrocast Ni—P alloy having a phosphorus content of 0.05 mass % to 1 mass %. When the phosphorus content is less than 0.05 mass %, the first heating layer 11 formed of electrocast nickel may improve insufficient heat/fatigue resistance, whereas when the phosphorus content is in excess of 1 mass %, the first heating layer 11 formed of electrocast nickel may exhibit poor softness.

The first heating layer 11 formed of electrocast nickel may be generally formed through electrocasting by use of a nickel electrocasting bath, for example, a Watts bath containing as a predominant component nickel sulfate or nickel chloride, or a sulfamate bath containing as a predominant component nickel sulfamate. The electrocating process is a method which includes performing thick-plating on the surface of a substrate and removing the plating from the substrate.

The first heating layer 11 formed of electrocast nickel may be produced through nickel-plating on the surface of a cylindrical substrate made of stainless steel, brass, aluminum, etc. by use of a nickel electrocasting bath. In the case where the substrate is made of a non-conducting material such as silicone resin or gypsum, the non-conducting substrate is subjected to a conducting-property-imparting treatment by use of graphite or copper powder or through silver mirror reaction or sputtering. In electrocasting on a metal substrate, for facilitating release of nickel plate film, the surface of the substrate is preferably subjected to a release-facilitating treatment by forming oxide film, compound film, graphite powder film, etc. on the surface of the substrate.

The nickel electrocasting bath contains a nickel ion source, an anode dissolving agent, a pH buffer, and other additives. Examples of the nickel ion source include nickel sulfamate, nickel sulfate, and nickel chloride. In the case of a Watts bath, nickel chloride serves as an anode dissolving agent. In other nickel plating baths, ammonium chloride, nickel bromide, etc. are used as an anode dissolving agent. Nickel plating is generally performed at a pH of 3.0 to 6.2. In order to adjust the pH to fall within the preferred range, a pH buffer such as boric acid, formic acid, or nickel acetate is used. Other additives are also used for, for example, smoothing the plating surface, pit prevention, forming minute crystals, or reducing residual stress. Examples of such additives include a brightener, a pit-preventing agent, and an internal-stress-reducing agent.

The nickel electrocasting bath is preferably a sulfamate bath. One exemplary composition of the sulfamate bath includes nickel sulfamate tetrahydrate (300 to 600 g/L), nickel chloride (0 to 30 g/L), boric acid (20 to 40 g/L), a surfactant (appropriate amount), and a brightener (appropriate amount). The pH of the bath is 2.5 to 5.0, preferably 3.5 to 4.7, and the bath temperature is 20 to 65° C., preferably 40 to 60° C. When the first heating layer 11 is produced from nickel alloy through electrocasting, a nickel electrocasting bath containing an aqueous phosphorus-containing acid salt (e.g., sodium phosphite), a sulfamic acid mental salt (e.g., ferrous sulfamate, cobalt sulfamate, or manganese sulfamate), titanium potassium fluoride, and other additives may be used.

The thus-produced first heating layer 11 formed of an Ni—P alloy by use of the nickel electrocasting bath, in particular, a nickel sulfamate bath containing phosphorus under the aforementioned conditions exhibits improved heat/fatigue resistance.

The second heating layer 12 is formed of a non-magnetic material. The second heating layer 12 has a thickness of, for example, 2 to 30 μm, preferably 5 to 20 μm. The thickness of the second heating layer 12 is preferably adjusted to be smaller than that of the first heating layer 11. Generally, when a non-magnetic material layer has a very small thickness, the surface resistivity of the layer increases, to thereby prevent generation of an opposing magnetic field. As a result, magnetic flux readily passes the thin layer, whereby electromagnetic induction heating can be facilitated. Thus, when the thickness of the second heating layer 12 increases, an opposing magnetic field is generated upon application of magnetic flux, to thereby provide opposing current. As a result, the magnetic flux may fail to pass through the non-magnetic material. Also, the second heating layer 12 preferably has a thickness equal to or less than the skin depth of the material that forms the second heating layer. As used herein, the term "skin depth" refers to thickness induction current flows. When the second heating layer has a thickness less than the skin depth, magnetic flux can pass through the layer.

The second heating layer 12 is formed of a non-magnetic material, preferably a material having a resistivity lower than that of nickel. When the second heating thin layer 12 is formed from a material having a resistivity lower than that of the first heating layer, the amount of heat generated by the second heating layer 12 increases.

The second heating layer 12 is preferably formed of a material having a resistivity of $2.8\times10^{-8}$ Ω·m or lower and a relative permeability of 2 or lower. When the second heating layer has a relative permeability as small as 2 or less, the skin depth of the second heating layer increases. Even though the second heating layer has a resistivity as small as $2.8\times10^{-8}$ Ω·m or lower, when the thickness thereof is reduced, the surface resistivity of the layer increases, whereby sufficient heat generation can be attained. Through appropriately controlling the thickness of the second heating layer 12, heat generation can be focused on the thin second heating layer.

Examples of the material of the second heating layer 12 include gold, silver, aluminum, copper, and alloys thereof. Among them, copper is preferred from the viewpoints of cost and good adhesion to the first heating layer.

The second heating layer 12 is preferably formed through electroplating. In one exemplified mode, a plating film is formed on the surface of the first heating layer 11 by use of a plating bath, and the formed film is employed as the second heating layer 12. The second heating layer 12 produced through plating ensures good adhesion to the first heating layer 11. In the case where copper is used as the material of the second heating layer 12, copper plating film is formed by use of a copper plating bath. Examples of the copper plating bath include a copper sulfate plating bath, a copper pyrophosphate plating bath, a copper cyanide plating bath, and a copper electroless plating bath. Of these, a copper sulfate plating bath is preferably used. An example of the copper sulfate plating bath is a bath containing copper sulfate (150 to 250 g/L), sulfuric acid (30 to 150 g/L), hydrochloric acid (0.125 to 0.25 mL/L), and a brightener (appropriate amount). Alternatively, the second heating layer 12 may be formed through electroless plating, physical vapor deposition, chemical vapor deposition, or a similar process.

In this embodiment, the elastic layer 14 is provided for the purpose of enhancement of the obtained image quality. However, needless to say, the elastic layer 14 may or may not optionally be provided in accordance with need. In other words, the release layer 15 may be formed on the outer peripheral surface of the coating layer 13. The elastic layer 14 is preferably formed from a material having high heat resistance. Examples of the material include silicon rubber, fluorine rubber, and urethane rubber. Of these, silicone rubber is particularly preferred. The thickness of the elastic layer 14 is, for example, 20 to 1,000 μm, preferably 50 to 500 μm.

The release layer 15 is preferably formed from a highly releasable synthetic resin material, preferably fluororesin or the like. The thickness of the release layer 15 is, for example, 1 to 150 μm, preferably 5 to 50 μm.

The sliding layer 16 is provided for the purpose of enhancement of sliding property. However, needless to say, the sliding layer 16 may or may not optionally be provided in accordance with need. Examples of the material of the sliding layer 16 include polyimide and fluororesin. The thickness of the sliding layer 16 is generally 5 to 100 μm, preferably 10 to 60 μm.

Figure 2:
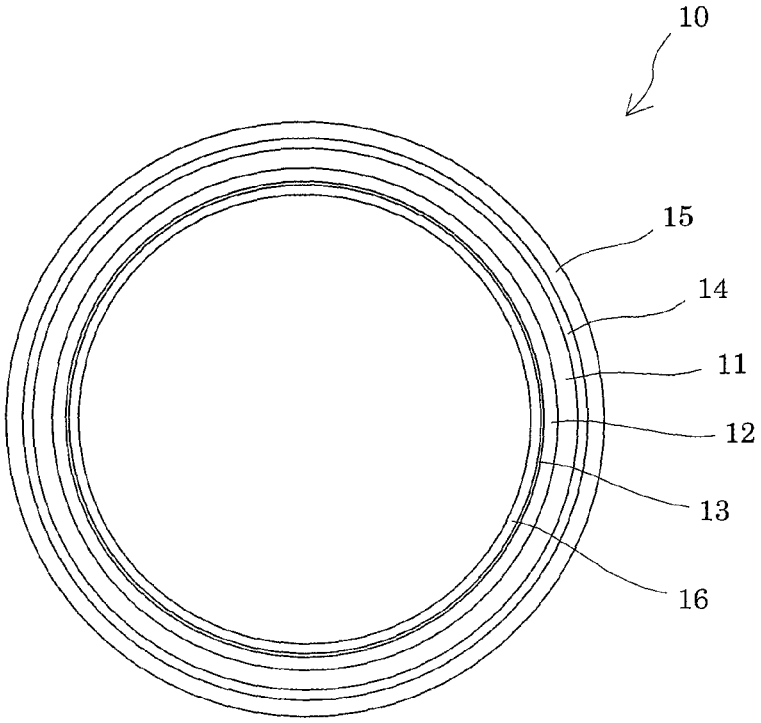
FIG. 2 A sketch of a fixing belt according to another embodiment of the present invention.

The fixing belt 10 of the embodiment is preferably employed in the case where an exciting coil (heat source) is placed outside the fixing belt 10. In this embodiment, the first heating layer 11 formed of electrocast nickel and having an endless-belt-like form, the second heating layer 12 formed of a non-magnetic material, and the coating layer 13 having a thickness of 3 μm or less are provided inside the fixing belt 10 in this order. However, no particular limitation is imposed on the stacking mode of the layers. For example, when an exciting coil (heat source) is placed inside the fixing belt 10, the coating layer 13 having a thickness of 3 μm or less, the second heating layer 12 formed of a non-magnetic material, and the first heating layer 11 formed of electrocast nickel and having an endless-belt-like form are preferably provided inside the fixing belt 10 in this order, as shown in FIG. 2.

The electromagnetic induction heating element of the present invention is suitably employed in a fixing belt. However, the heating element may also be used in, for example, a transfer-fixing belt, which fixes images immediately after image transfer.

EXAMPLES

The present invention will next be described by way of examples, which should not be construed as limiting the invention thereto.

Example 1

A sulfamic acid-phosphorus electroplating bath was prepared from nickel sulfamate (500 g/L), sodium phosphite (150 mg/L), boric acid (30 g/L), trisodium naphthalene-1,3,6-trisulfonate serving as a primary brightener (1.0 g/L), and 2-butyne-1,4-diol serving a secondary brightener (20 mg/L).

The temperature and pH of the electroplating bath were adjusted to 60° C. and 4.5, respectively. By use of a hollow cylindrical stainless steel substrate (outer diameter: 34 mm) serving as a cathode, and depolarized nickel serving as an anode, electroplating was performed at a current density of 16 A/dm$^2$, to thereby deposit a plating film (thickness: 50 μm) form on the outer peripheral surface of the substrate. The electrodeposited film was removed from the substrate, to thereby yield a first heating layer (inner diameter: 34 mm, thickness: 50 μm) formed of an electrocast nickel-phosphorus alloy. The first heating layer was found to have a phosphorus content of 0.5 mass %.

On the first heating layer, a second heating layer was formed from an electroplating bath having the following composition. Specifically, a copper sulfate electroplating was prepared from copper sulfate (180 g/L), sulfuric acid (60 g/L), thiourea (0.04 g/L), and syrup (0.8 g/L). Subsequently, while the electroplating bath was maintained at 45° C., electroplating was performed at a current density of 5 A/dm$^2$, by use of the aforementioned electrodeposited film serving as a cathode and phosphorus-containing copper serving as an anode, to thereby form a second heating layer having a thickness of 15 μm on the first heating element. The second heating layer was found to have a resistivity of $1.7\times10^{-8}$ Ω·m and a relative permeability of 1.6.

Through the same procedure, a coating layer (thickness: 2 μm) formed of a nickel-phosphorus alloy was formed on the second heating layer. The thus-formed product was removed from the electroplating bath, and fins of both ends were cut out, to thereby yield an electromagnetic induction heating element of a tri-layer structure.

Example 2

The procedure of Example 1 was repeated, except that the thickness of the coating layer was adjusted to 0.5 μm, to thereby produce an electromagnetic induction heating element of Example 2.

Example 3

The procedure of Example 1 was repeated, except that the thickness of the coating layer was adjusted to 3 μm, to thereby produce an electromagnetic induction heating element of Example 3.

Comparative Example 1

The procedure of Example 1 was repeated, except that no coating layer was provided, to thereby produce an electromagnetic induction heating element of Comparative Example 1.

Comparative Example 2

The procedure of Example 1 was repeated, except that the thickness of the coating layer was adjusted to 5 μm, to thereby produce an electromagnetic induction heating element of Comparative Example 2.

Examples 4 to 6 and Comparative Examples 3 and 4

On the outer peripheral surface of each of the electromagnetic induction heating elements of Examples 1 to 3 and Comparative Examples of 1 and 2, a silicone rubber layer (thickness: 300 μm) was formed. The silicone rubber layer was coated with a PFA tube (thickness: 30 μm) by use of a silicone rubber-based adhesive, to thereby provide fixing belts of Examples 4 to 6 and Comparative Examples 3 and 4.

Example 7

The procedure of Example 1 was repeated, except that, instead of the nickel-phosphorus alloy coating layer, a coating layer (2 μm) formed of Ni—Fe alloy (Ni 22%, Fe 78%) through the following method was provided, to thereby yield an electromagnetic induction heating element of Example 7.

<Method of Producing Coating Layer Formed of Ni—Fe Alloy>

An iron sulfamate electroplating bath of interest was prepared from nickel sulfamate tetrahydrate (125 g/L), ferrous sulfamate (185 g/L), sodium acetate (27 g/L), and nickel chloride (in an amount required for electrolysis of the anode).

The temperature and pH of the electroplating bath were adjusted to 30° C. and 3, respectively. By use of the second heating layer serving as a cathode, and Ni—Fe alloy (Ni 40%, Fe 60%) serving as an anode, electroplating was performed at a current density of 5 A/dm$^2$, to thereby deposit a plating film (thickness: 2 μm) form on the outer peripheral surface of the second heating layer. The thus-formed product was removed from the electroplating bath, and fins of both ends were cut out, to thereby yield an electromagnetic induction heating element of a tri-layer structure.

Example 8

The procedure of Example 1 was repeated, except that, instead of the nickel-phosphorus alloy coating layer, a coating layer (2 μm) formed of Ni—Co alloy (Ni 40%, Co 60%) through the following method was provided, to thereby yield an electromagnetic induction heating element of Example 8.

<Method of Producing Coating Layer Formed of Ni—Co Alloy>

A cobalt sulfamate electroplating bath of interest was prepared from nickel sulfamate (80 g/L), cobalt sulfamate (16 g/L), nickel bromide (14 g/L), and boric acid (30 g/L).

The temperature and pH of the electroplating bath were adjusted to 50° C. and 3, respectively. By use of the second heating layer serving as a cathode, and Ni—Co alloy (Ni 75%, Co 25%) serving as an anode, electroplating was performed at a current density of 5 A/dm$^2$, to thereby deposit a plating film (thickness: 2 μm) form on the outer peripheral surface of the second heating layer. The thus-formed product was removed from the electroplating bath, and fins of both ends were cut out, to thereby yield an electromagnetic induction heating element of a tri-layer structure.

Example 9

The procedure of Example 1 was repeated, except that, instead of the nickel-phosphorus alloy coating layer, a coating layer (2 μm) formed of Ni—Mn alloy (Ni 99.2%, Mn 0.8%) through the following method was provided, to thereby yield an electromagnetic induction heating element of Example 9.

<Method of Producing Coating Layer Formed of Ni—Mn Alloy>

A manganese sulfamate electroplating bath of interest was prepared from nickel sulfamate (80 g/L), manganese sulfamate (30 g/L), boric acid (30 g/L), and an activator (375 g/L).

The temperature and pH of the electroplating bath were adjusted to 55° C. and 3.5, respectively. By use of the second heating layer serving as a cathode, and depolarized nickel serving as an anode, electroplating was performed at a current density of 4 A/dm$^2$, to thereby deposit a plating film (thickness: 2 μm) form on the outer peripheral surface of the second heating layer. The thus-formed product was removed from the electroplating bath, and fins of both ends were cut out, to thereby yield an electromagnetic induction heating element of a tri-layer structure.

Example 10

The procedure of Example 1 was repeated, except that, instead of the nickel-phosphorus alloy coating layer, a coating layer (2 μm) formed of nickel through the following method was provided, to thereby yield an electromagnetic induction heating element of Example 10.

<Method of Producing Ni Coating Layer>

A sulfamate electroplating bath of interest was prepared from nickel sulfamate (450 g/L), boric acid (30 g/L), saccharin (2 g/L), and butynediol (0.3 g/L).

The temperature and pH of the electroplating bath were adjusted to 50° C. and 4.5, respectively. By use of depolarized nickel serving as an anode, electroplating was performed at a current density of 20 A/dm$^2$, to thereby deposit a plating film (thickness: 2 μm) form on the outer peripheral surface of the second heating layer. The thus-formed product was removed from the electroplating bath, and fins of both ends were cut out, to thereby yield an electromagnetic induction heating element of a tri-layer structure.

Examples 11 to 14

On the outer peripheral surface of each of the electromagnetic induction heating elements of Examples 7 to 10, a silicone rubber layer (thickness: 300 μm) was formed. The silicone rubber layer was coated with a PFA tube (thickness: 30 μm) by use of a silicone rubber-based adhesive, to thereby provide fixing belts of Examples 11 to 14.

Test Example 1

Heat Generation (Heating) Test

Each of the electromagnetic induction heating elements produced in Examples 1 to 3 and 7 to 10 and Comparative Examples 1 and 2 was subjected to a heating test by means of an IH cocker (model KZ-PH30P, Panasonic) in the following manner.

Each electromagnetic induction heating element was cut to test pieces (100 mm×120 mm), and each test piece was placed on the center of the aforementioned cocker. Then, a 2000-mL beaker containing pure water (500 mL) and a thermo-sensor was placed on the test piece and heated at a frequency of 20 KHz and an input power of 700 W. The time required for pure water to heat from 35° C. to 100° C. was measured. The measurement was performed five times, and the measurements were averaged. Table 1 shows the results.

TABLE 1

| | Time (sec) |
|---|---|
| Ex. 1 | 408 |
| Ex. 2 | 399 |
| Ex. 3 | 415 |
| Ex. 7 | 410 |
| Ex. 8 | 410 |
| Ex. 9 | 408 |
| Ex. 10 | 408 |
| Comp. Ex. 1 | 396 |
| Comp. Ex. 2 | 436 |

Test Example 2

Durability Test

Each of the fixing belts produced in Examples 4 to 6 and 11 to 14 and Comparative Examples 3 and 4 was employed in a printer (Color Laser Jet 5550dn, HP) and subjected to the following durability test.

Specifically, each fixing belt was incorporated into the printer and rotated for 200 hours at a fixation temperature 200° C. through electromagnetic induction heating without passing actual sheets of paper through. The status of the fixing belt after 200 hours' rotation was observed for evaluating durability. When no delamination was observed after 200 hours' rotation, the case was rated with "O," whereas when delamination was observed after 200 hours' rotation, the case was rated with "X." Table 2 shows the results.

TABLE 2

| | Durability |
|---|---|
| Ex. 4 | ○ |
| Ex. 5 | ○ |
| Ex. 6 | ○ |
| Ex. 11 | ○ |
| Ex. 12 | ○ |
| Ex. 13 | ○ |
| Ex. 14 | ○ |
| Comp. Ex. 3 | X |
| Comp. Ex. 4 | ○ |

Results

The electromagnetic induction heating elements of Examples 1 to 3 and 7 to 10 exhibited a time required for pure water to heat to 100° C. of 415 seconds or less, which is equivalent to that of the electromagnetic induction heating element of Comparative Example 1 having no coating layer, indicating that the electromagnetic induction heating elements of the Examples were excellent in heating efficiency. Also, the fixing belts produced from the electromagnetic induction heating elements exhibited excellent durability. That is, the electromagnetic induction heating element of the present invention was found to be excellent in heating efficiency and durability.

In contrast, the electromagnetic induction heating element of Comparative Example 2 provided with a coating layer having a thickness of 5 μm exhibited a time required for pure water to heat to 100° C. of 436 seconds, indicating a considerable drop in heating efficiency. The fixing belt of Comparative Example 3 produced from the electromagnetic induction heating element of Comparative Example 1 having no coating layer caused delamination, indicating poor durability.

As described hereinabove, through coating the outer peripheral surface of the non-magnetic metallic layer with a coating layer having a thickness of 3 μm or less, the non-magnetic metallic layer can be protected, to thereby enhance durability. Also, the invention was found to enable provision of an electromagnetic induction heating element which attains both high heat generation efficiency and high durability, and a fixing belt employing the heating element, virtually without lowering the induction heating efficiency.

BRIEF DESCRIPTION OF REFERENCE NUMERALS

10 fixing belt
11 first heating layer
12 second heating layer
13 coating layer
14 elastic layer
15 release layer
16 sliding layer

The invention claimed is:

1. A method for producing a fixation belt, the method comprising steps of:

forming a first heating layer formed of electrocast nickel having a thickness in a range of 10 μm to 100 μm and having an endless belt form;

forming a second heating layer formed of a non-magnetic material having a thickness in a range of 2 μm to 30 μm and located on said first heating layer;

forming a coating layer having a non-zero thickness equal to or less than 2 μm and located on said second heating layer, wherein the first heating layer, the second heating layer, and the coating layer are sequentially stacked in an outward radial direction; and forming a release layer located radially outermost of said first heating layer, said second heating layer, and said coating layer, wherein the second heating layer is formed through electroplating, wherein the coating layer is formed through electroplating, and wherein the coating layer is formed without contacting the second heating layer with air.

2. The method for producing a fixation belt of claim 1, wherein the coating layer is formed of a metallic material which has corrosion resistance higher than that of the material forming the second heating layer.

3. The method for producing a fixation belt of claim 1, wherein the coating layer is formed of nickel or a nickel alloy.

4. The method for producing a fixation belt of claim 1, wherein the first heating layer has a phosphorus content of 0.05 mass % to 1 mass %.

5. The method for producing a fixation belt of claim 1, wherein the second heating layer is formed of a material having a resistivity lower than that of nickel.

6. The method for producing a fixation belt of claim 1, wherein the second heating layer is formed of a material having a resistivity of $2.8\times10^{-8}$ Ω·m or lower and a relative permeability of 2 or lower.

7. The method for producing a fixation belt of claim 1, wherein the second heating layer is formed of gold, copper, silver, or aluminum.

8. The method for producing a fixation belt of claim 1, wherein the second heating layer has a thickness which is equal to or less than the skin depth of the material of the second heating layer.

9. The method for producing a fixation belt of claim 1, further comprising an elastic layer located between the release layer and said coating layer.

10. The method for producing a fixation belt of claim 1, wherein the thickness of the coating layer is at least 0.5 μm.

* * * * *